US006076243A

United States Patent [19]

Sartain et al.

[11] Patent Number: 6,076,243

[45] Date of Patent: Jun. 20, 2000

[54] YARN END UNCROSSING APPARATUS

[75] Inventors: Stephen L. Sartain, Auburn; Vickie Danny Ritts, Opelika; Charlie R. Christian, LaFayette, all of Ala.

[73] Assignee: West Point Foundry and Machine Company, West Point, Ga.

[21] Appl. No.: 09/384,508

[22] Filed: Aug. 27, 1999

[51] Int. Cl.[7] ..... D02H 9/00; D02H 13/16

[52] U.S. Cl. ..... 28/199; 28/190; 28/195

[58] Field of Search ..... 28/172.1, 172.2, 28/190, 195, 196, 198, 199, 204, 208, 212, 213; 242/166, 176

[56] References Cited

U.S. PATENT DOCUMENTS

| | | | |
|---|---|---|---|
| 16,934 | 3/1857 | Pratt | 28/195 |
| 1,942,524 | 1/1934 | Welch et al. | 28/199 |
| 2,033,738 | 3/1936 | Reiners et al. | 28/195 |
| 2,092,811 | 9/1937 | Moncrieff et al. | 28/190 |
| 2,787,044 | 4/1957 | Smith | 28/212 |
| 2,972,796 | 2/1961 | Block | 28/196 |
| 3,991,448 | 11/1976 | Kracke et al. | 28/199 |

*Primary Examiner*—Amy B. Vanatta
*Attorney, Agent, or Firm*—Jones & Askew, LLP

[57] ABSTRACT

Apparatus used with a yarn warper or beamer to uncross yarn ends that have become crossed during a warping operation. An element shaped like a knuckle moves back and forth across a side of the yarn sheet while protruding into the path of yarn ends making up that sheet. The motion of the knuckle against the side of the yarn sheet raises each yarn slightly, then allows the yarn to return to its original position. This motion dislodges yarn ends that have become crossed and allows them to return to their proper registration in the yarn sheet. The end uncrossing device may be located either downstream or upstream from the comb assembly in a warper.

14 Claims, 4 Drawing Sheets

12
30
26
24
29
51
28
27
34
49b
35
18

AIR SUPPLY
11
18
24
26
28
29
30
34
35
38
39
40
41
43
44
45
49a
49b

YARN END UNCROSSING APPARATUS

FIELD OF INVENTION

This invention relates in general to winding plural yarn ends, and relates in particular to apparatus for warping or beaming a sheet of individual yarn ends.

BACKGROUND OF THE INVENTION

The process of warping or beaming yarn ends requires aligning numerous individual yarn ends, referred to as yarn ends, so that the yarn ends travel alongside each other to form a yarn sheet moving in a substantially plane path, and then winding the yarn sheet to produce a warp beam. The yarn ends may be drawn from individual yarn packages on a creel, or may originate from a previously-prepared warp rope. Details of warp beaming in general are well known to those skilled in the art.

During the warping process, the yarn ends pass through a comb to align the yarn ends on the yarn sheet with predetermined spacing between each yarn. After leaving the comb, the yarn ends making up the yarn sheet are drawn across a carrier roll and then are wound to form the beam. During the warping process, individual yarn ends can become crossed between the comb and the carrier roll, for example, when the warper is stopped or is accelerating the yarn sheet. The crossed yarn ends often remain crossed as wound on the beam. Those crossed yarn ends often break when the yarn sheet is unwound from the beam for subsequent processing.

SUMMARY OF THE INVENTION

It is an object of the present invention to provide improved apparatus for winding yarn ends.

It is another object of the present invention to provide improved apparatus for warping numerous yarn ends onto a beam.

It is a further object of the present invention to provide apparatus for uncrossing yarn ends that become crossed while winding the yarn ends.

The foregoing and other objects are accomplished by yarn end uncrossing apparatus according to the present invention. Stated in general terms, the present invention uncrosses yarn ends in a yarn sheet by temporarily displacing individual yarn ends from the nominal path traveled by the yarn sheet. This displacement of individual yarn ends is momentary, and preferably occurs on substantially less than the entire width of the yarn sheet at any given moment. The momentary displacement of individual yarn ends dislodges yarn ends that have become crossed and allows those yarn ends to return to their proper registration in the yarn sheet.

Stated in somewhat greater detail, crossed yarn ends are uncrossed by contacting the yarn sheet with an element that passes back and forth across the yarn sheet. The motion of this element causes a slight displacement of each yarn, and then allows each yarn end to return to its original position in the plane of the yarn sheet. This momentary displacement dislodges yarn ends that have become crossed, as previously mentioned. The movement back and forth across the yarn sheet preferably is repetitive, so that the displacement element cyclically moves back and forth across the yarn sheet at a speed that may be varied to produce best results according to particular operational parameters of a beaming operation.

The yarn contacting element preferably is configured to displace only a relatively few yarn ends from the yarn sheet at any particular position of the element across the width of the yarn sheet. The yarn contacting element preferably has a curved smooth surface to engage and displace yarn ends from the yarn sheet without snagging or laterally dislocating yarn ends, during back and forth movement of the element.

Further objects of the present invention will become apparent during the following discussion of a preferred embodiment.

DETAILED DESCRIPTION OF PREFERRED EMBODIMENTS

Figure 1:
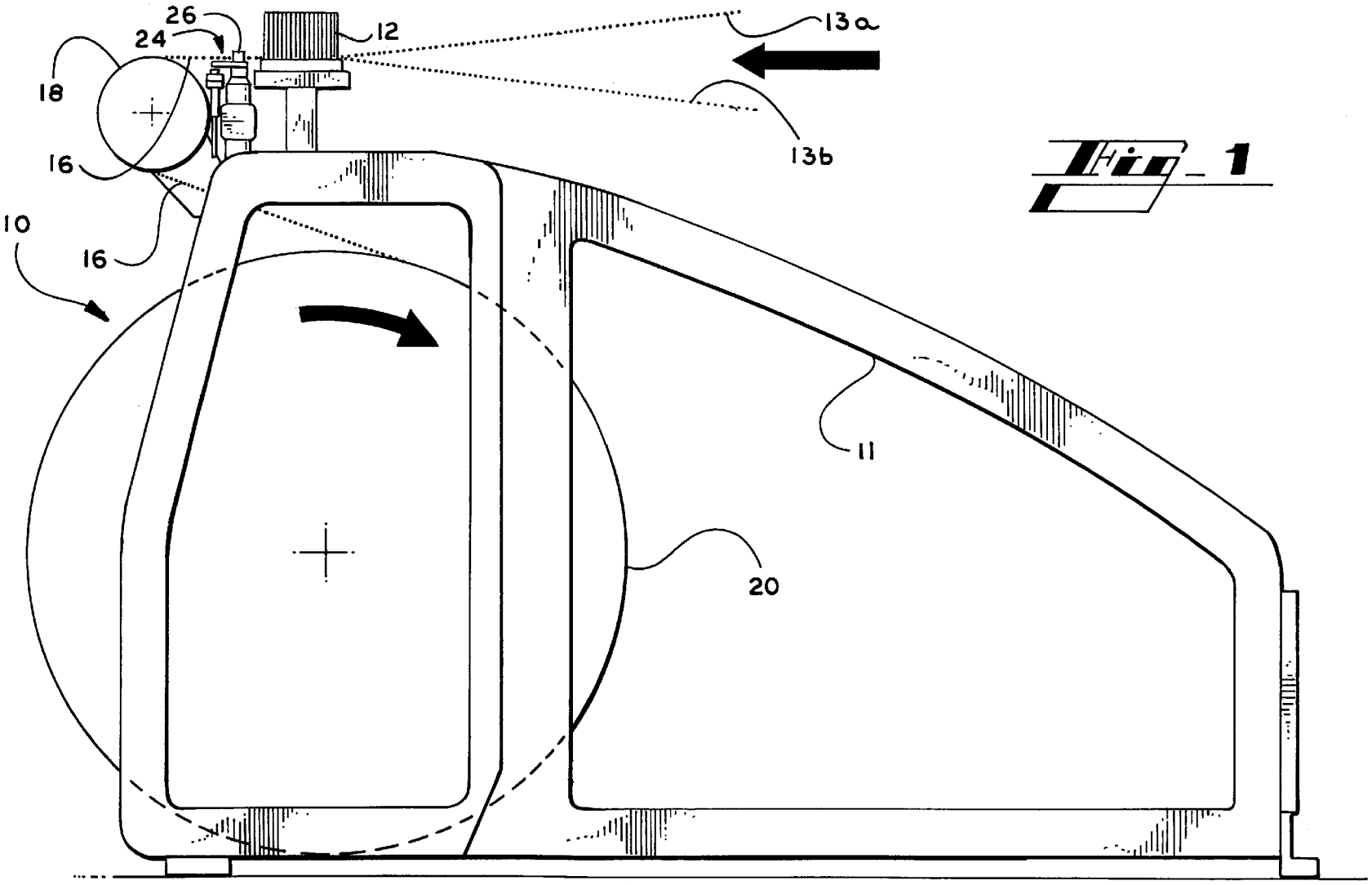
FIG. 1 is a side elevation view showing a warper equipped with yarn end uncrossing apparatus according to a preferred embodiment of the present invention.

FIG. 1 shows generally at 10 a warper having a frame 11 supporting at an upper side thereof a comb assembly 12 through which are threaded many yarn ends represented by the yarn ends 13*a* and 13*b*. Those individual yarn ends may be drawn from a creel in a manner known to those in the art, and the yarn ends may arrive at the comb 12 along different elevations as indicated by the paths of the yarn ends 13*a* and 13*b*. The numerous yarn ends are drawn through the comb assembly to form a substantially plane yarn sheet 16, with regular spacing between individual yarn ends as determined by the individual fingers making up the comb assembly 12.

The yarn sheet 16 is drawn downstream from the comb assembly 12 and passes over a carrier roll 18 rotatably mounted at one end of the frame 11. The yarn sheet 16 then passes beneath the carrier roller 18 and becomes wound on the beam 20, located in the frame 11 generally below the carrier roll and the comb assembly 12 and driven for rotation in a manner known to those skilled in the art.

Figure 2:
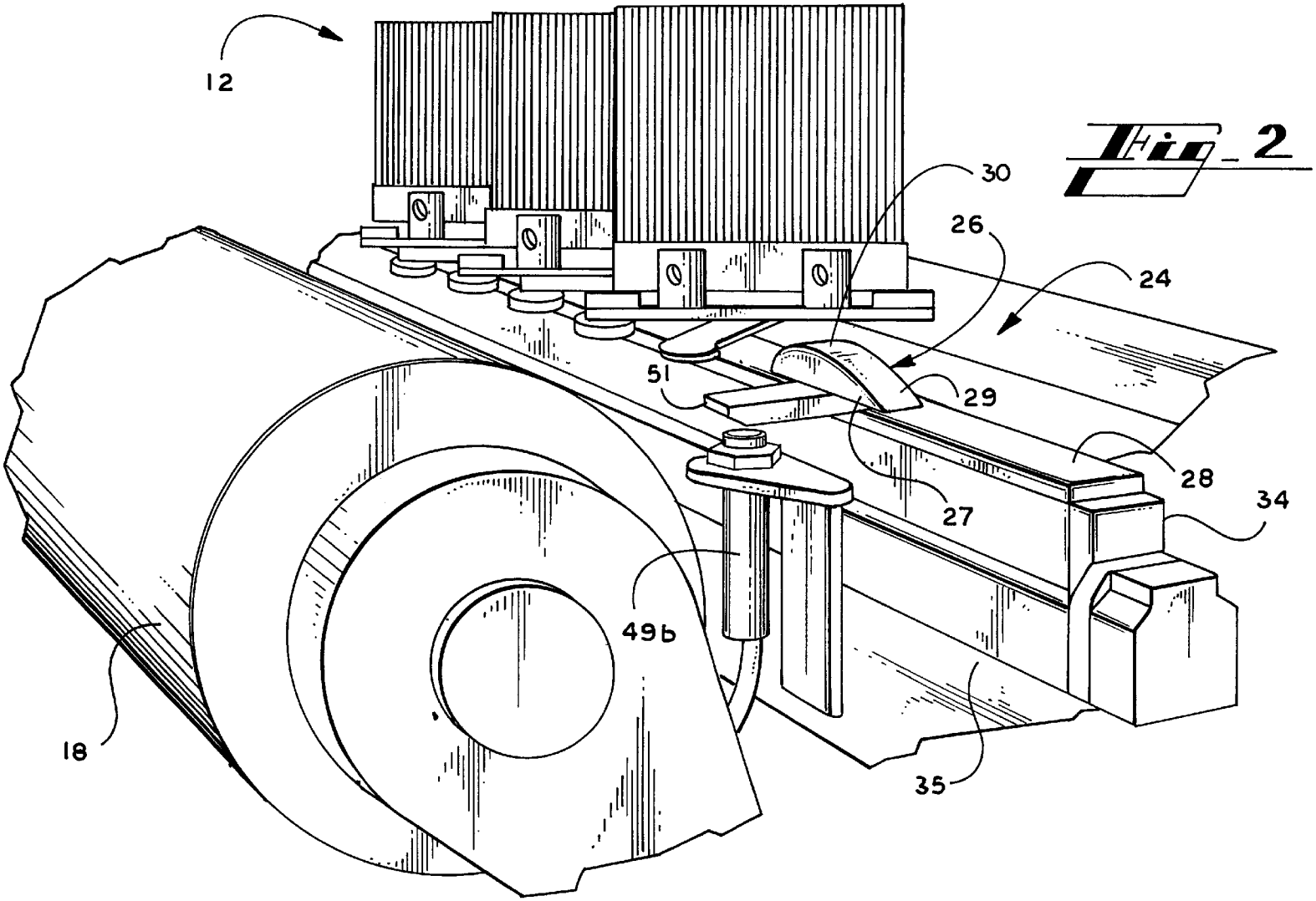
FIG. 2 is a fragmentary pictorial view of the apparatus shown in FIG. 1.
Figures 3, 4:
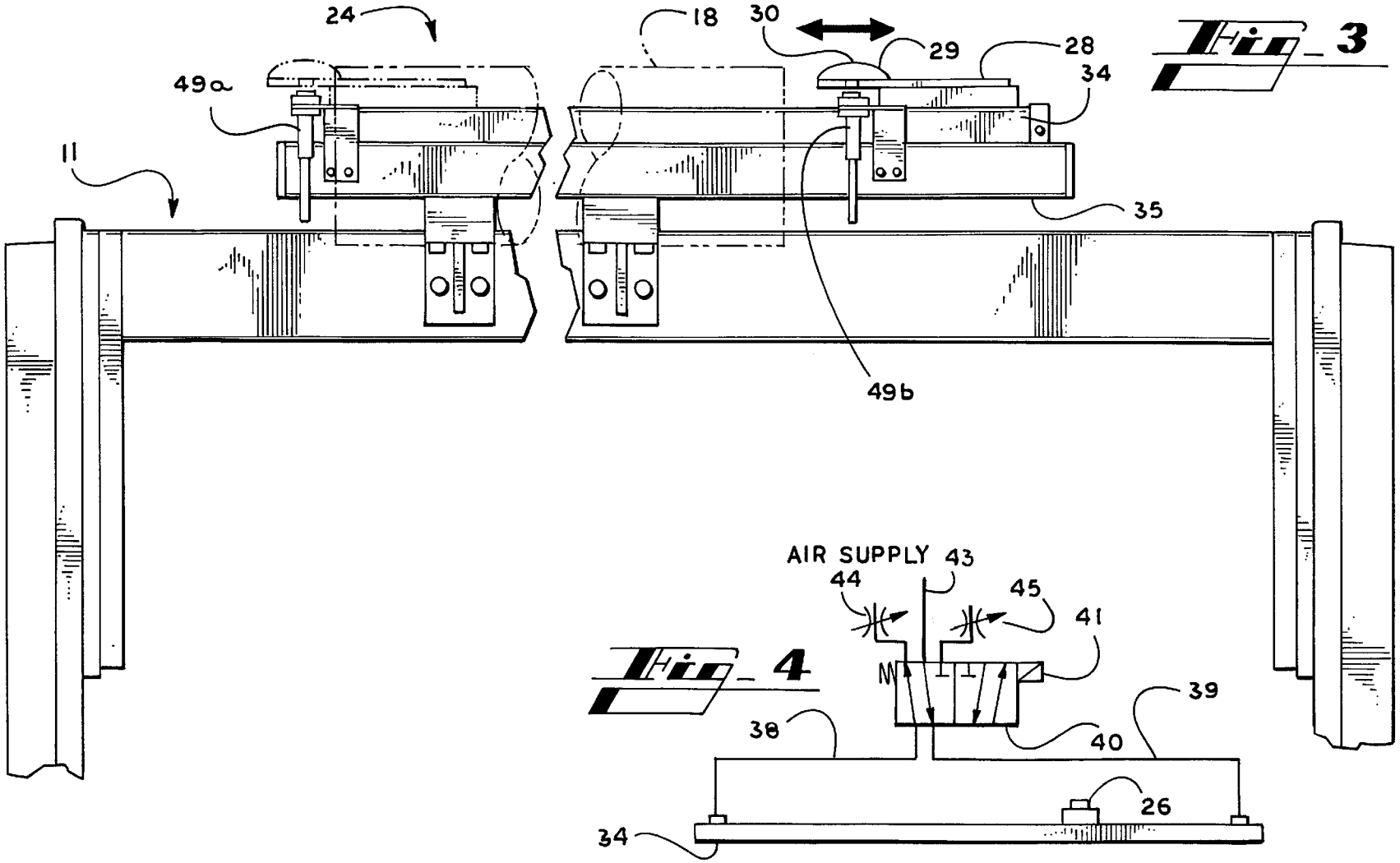
FIG. 3 is an end elevation view, partially broken for illustrative purposes, taken from the left side of FIG. 1.
FIG. 4 is a semischematic view showing the air operating mechanism for the disclosed embodiment.

The warper 10 is equipped with yarn end uncrossing apparatus shown generally at 24 in FIG. 1, and seen in greater detail in FIGS. 2 and 3. The yarn end apparatus 24 is located between the comb assembly 12 and the carrier roll 18 in the embodiment of FIGS. 1–3, and is supported on the frame 11 adjacent the lower side of the yarn sheet 16 departing the comb assembly. However, it will be seen that the yarn end uncrossing apparatus may alternatively be located upstream from the comb assembly so as to act on yarn ends arriving at that assembly, as discussed below with regard to the alternative embodiment shown in FIG. 5.

The apparatus 24 includes a yarn end displacing element in the form of a knuckle 26. As best shown in FIG. 1, the knuckle 26 protrudes slightly into the nominal plane of the yarn sheet 16 (not shown in FIGS. 2 and 3). The knuckle 26 in the preferred embodiment has approximately the shape of a solid cylindrical sector, with a base 27 mounted on a carrier plate 28 and having a curved yam-contacting surface 29 extending upwardly from the base to an upper most or distal surface 30 forming the uppermost portion of the knuckle 26. The curved yarn-engaging surface 29 is symmetrical around the uppermost distal portion 30, so that the knuckle presents a smooth and snag-free surface for contacting the yarn ends as the knuckle is moved back and forth across one side of the yarn sheet.

The carrier plate for the knuckle 26 is supported for movements back and forth across the path of the yarn sheet by means of a suitable motor, which in the disclosed embodiment comprises a rodless cylinder 34. That rodless cylinder is mounted on a support tube 35 fastened to the frame 11 of the warper, with both the support tube and the rodless motor extending across the path of the yarn sheet 16 so that operation of the rodless pneumatic cylinder traverses the carrier plate 28 and the knuckle 26 back and forth along a path transverse to the path traveled by the yarn sheet. Details of rodless cylinders are known in the art and need not be repeated herein.

Although an air-powered rodless cylinder is used in the preferred embodiment as the motor to move the knuckle, it should be understood that other kinds of motors and related control apparatus may be substituted. Examples of alternative motive mechanisms include an electric motor coupled to the knuckle through a suitable mechanism for converting rotary motion to linear movement, a linear actuator, and a cylinder arrangement operated by hydraulic instead of pneumatics as in the disclosed embodiment.

FIG. 4 shows the pneumatic control circuit associated with the rodless cylinder 34. The two ends of that cylinder are connected by air lines 38 and 39 to a two-position valve 40 operated by the solenoid 41. The line 43 supplies input air pressure to the valve 40, which selectively applies that air pressure to either end of the cylinder 34 through the lines 38 or 39, depending on the position of the valve. In either such position, exhaust air from the cylinder 34 flows through separate flow control valves 44 and 45 connected to corresponding output ports of the valve 40. The flow control valves 44 and 45 are adjustable to vary the flow rate of exhaust air, thereby varying the rate at which the cylinder 34 traverses the knuckle 26 back and forth across the yam sheet.

The position of the solenoid 41 (and thus of the air valve 40) is controlled through suitable circuitry receiving signals from the separate proximity switches 49*a* and 49*b* mounted on the support tube 35 alongside opposite ends of the cylinder 34, as best seen in FIG. 3. These proximity switches sense the presence of a finger 51 extending outwardly from the carrier plate 28 that supports the knuckle 26. The two proximity switches 49*a*, 49*b* are positioned with respect to the cylinder 34 so that the finger 51 actuates either proximity switch as the cylinder arrives at the desired end of travel in either direction, namely, when the knuckle 29 completes its traverse across the yarn sheet in either direction. When the appropriate proximity switch senses the finger 51, that switch sends a signal through appropriate control circuitry to the solenoid 41, thereby toggling the valve 40 to reverse the direction of operating power applied to the cylinder 34.

The yarn end uncrossing apparatus typically is operated when the warper is stopped and during acceleration of the warper, events that are conducive to yarn ends becoming crossed between the comb assembly 12 and the carrier roll 18. The uncrossing apparatus is started by applying air pressure through the supply line 43 to the control valve 40, which powers the cylinder 34 to move the knuckle 26 across the nominal path traveled by the yarn sheet 16. Because the knuckle 26 protrudes into the path of the yarn sheet, the knuckle contacts the underside (in the disclosed embodiment) of the yarn sheet while passing cyclically back and forth across the yarn sheet. The motion of the knuckle against the lower side of the yarn sheet raises each yarn end slightly, and then allows the yarn end to return to its original position in the path of the yarn sheet. This motion dislodges yarn ends that have become crossed, and allows those yarn ends to return to their proper registration in the yarn sheet as the yarn sheet moves toward the carrier roll 18. The customary winding tension applied to the yarn sheet by the beam 20 maintains the yarn ends uncrossed after moving over the carrier roll 18.

Figure 5:
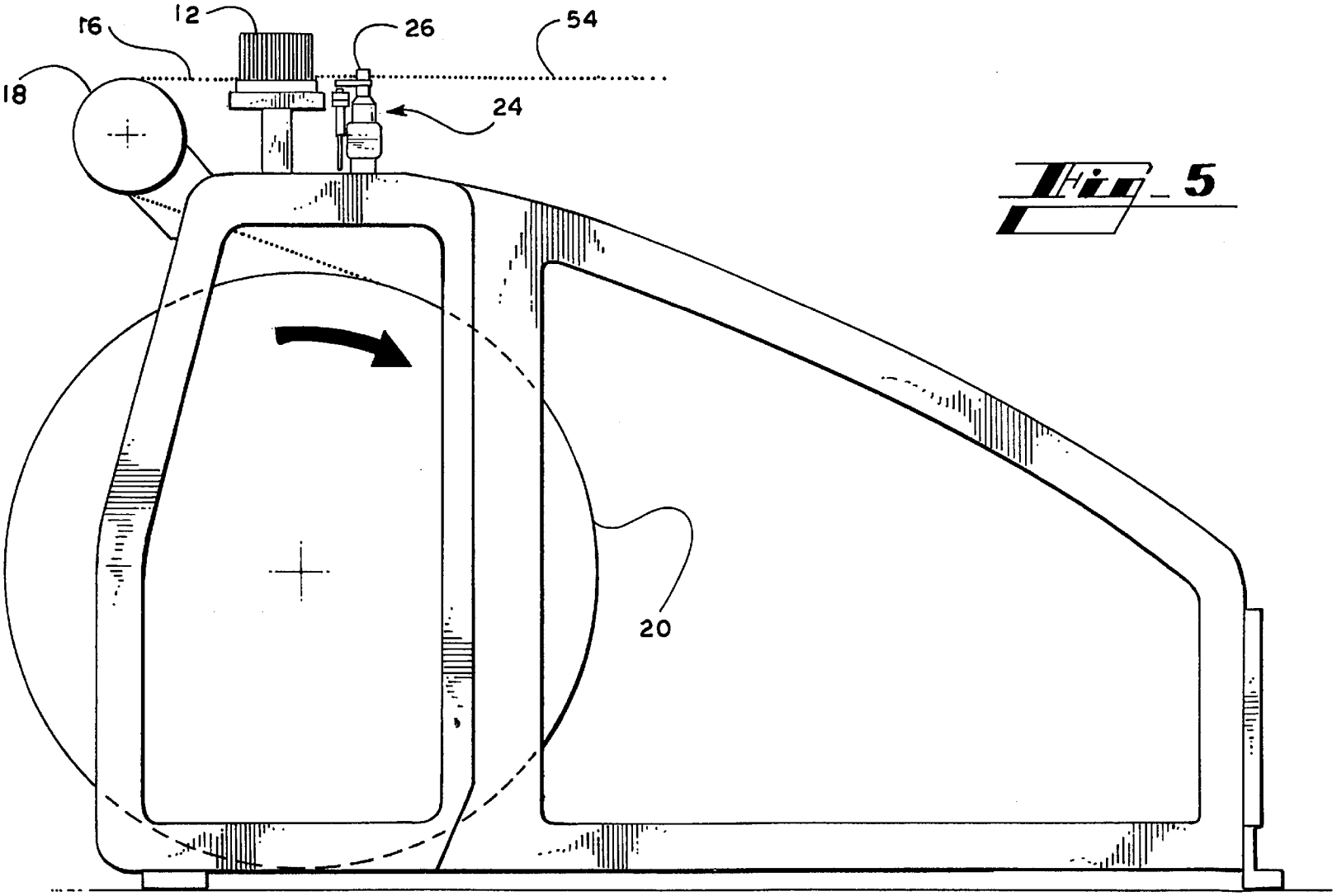
FIG. 5 is a side elevation view of a warper showing alternative placement of the yarn end uncrossing apparatus.

FIG. 5 discloses a warper with the yarn end uncrossing apparatus 24 located on the incoming or upstream side of the comb assembly 12. The yarn end uncrossing apparatus 24 shown in FIG. 5 is identical to the corresponding apparatus shown in FIGS. 1–4 and described above. The knuckle 26 of the yarn end uncrossing apparatus 24, protrudes slightly in the path of the yarn ends 54 arriving at the comb assembly in the embodiment of FIG. 5, slightly raising each yarn end and dislodging crossed yarn ends before the yarn ends enter the comb assembly. The apparatus shown in FIG. 5 is useful in the chain beaming process, wherein yarn ends 54 arrive at the comb assembly from a warp rope leaving a storage tub. The motion of the knuckle 26 in the yarn end uncrossing apparatus 24 helps separate crossed and rolled yarn ends as the rope is spread out and enters the comb assembly.

It should be understood that the foregoing relates only to preferred embodiments of the invention, and that numerous modifications and changes therein may be made without departing from the spirit and scope of the invention as defined in the following claims.

What is claimed is:

1. A warping apparatus for winding a plurality of individual yarn ends along a path to form a sheet of yarn, comprising:

a comb through which the individual yarn ends pass along the path to maintain the yarn ends separate from each other;

a roll located downstream from the comb along the path and positioned for contact by the moving yarn sheet after passing through the comb; and an element disposed adjacent the path for movement back and forth across the yarn sheet to displace each yarn end of the yarn sheet relative to the path, thereby dislodging yarn ends that may have become entangled with other yarn ends and then allowing the dislodged yarn ends to return to the path of the yarn sheet.

2. The apparatus as in claim 1, wherein the element is disposed beneath the yarn sheet and contacts the underside of the yarn sheet while moving from side to side, so as to raise the yarn ends.

3. The apparatus as in claim 2, wherein the element protrudes into the path of the yarn sheet, so as to contact and raise the individual yarn ends as the element moves across the yarn sheet.

4. The apparatus as in claim 1, wherein the element is operative for cyclical movement across the yarn sheet.

5. The apparatus as in claim 1, wherein the element is disposed between the comb and the roll, downstream from the comb.

6. The apparatus as in claim 1, wherein the element is disposed upstream from the comb.

7. Apparatus for winding a plurality of individual yarn ends along a substantially flat path to form a yarn sheet, comprising:

a comb through which the individual yarn ends pass to maintain the yam ends separate from each other;

a roll positioned along the path downstream from the comb so that the yarn sheet moves over the roll; and means positioned adjacent the path at one side of the comb and operative to momentarily displace the yarn ends of the yarn sheet relative to the path, so as to dislodge individual yarn ends that have become entangled with other yarn ends.

8. The apparatus as in claim 7, wherein the means is located downstream from the comb so as to momentarily displace yarn ends moving away from the comb.

9. The apparatus as in claim 7, wherein the means is located upstream from the comb so as to momentarily displace yarn ends incoming to the comb.

10. The apparatus as in claim 7, wherein the means moves back and forth across the yarn sheet to displace the individual yarn ends from the path of the yarn sheet.

11. The apparatus as in claim 7, wherein the means displaces less than the entire width of the yarn sheet at a time, and travels back and forth across the yarn sheet so as to displace substantially all yarn ends of the yarn sheet during traverse across the yarn sheet.

12. The apparatus as in claim 7, wherein the means comprises:

an element protruding into the path of the yarn sheet along substantially less than the entire width of the yarn sheet so as to displace fewer than all yarn ends in the yarn sheet; and motive means operative to traverse the element back and forth across the path so that the element serially displaces all yarn ends of the yarn sheet.

13. The apparatus as in claim 12, wherein the element comprises:

a base supported for travel at one side of the path of the yarn sheet; and a yarn end contacting portion having a distal surface disposed across the path from the base, and curved sides extending between the distal surface and to the base, so that the distal surface and the sides of the element provide a smooth path for contacting and displacing yarn ends as the element travels back and forth across the yarn sheet.

14. The apparatus as in claim 12, wherein the motive means comprises:

a motor selectively operative to move the element in either of two directions relative to the yarn sheet;

a controller selectively operative to apply operating power to the motor for operation in either direction; and a switch operatively associated with the controller and responsive to the position of travel of the motor to switch the power applied to the motor, so that the motor alternately travels in the two directions to move the element back and forth across the yarn sheet.

* * * * *